US009362687B1

(12) United States Patent
Ju

(10) Patent No.: US 9,362,687 B1
(45) Date of Patent: Jun. 7, 2016

(54) ELECTRICAL CONNECTOR

(71) Applicant: LOTES CO., LTD., Keelung (TW)

(72) Inventor: Ted Ju, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/660,380

(22) Filed: Mar. 17, 2015

(30) Foreign Application Priority Data

Jan. 7, 2015 (CN) ..... 2015 2 0008324 U

(51) Int. Cl.
*H01R 13/66* (2006.01)
*H01R 13/03* (2006.01)

(52) U.S. Cl.
CPC ..... *H01R 13/665* (2013.01); *H01R 13/035* (2013.01); *H01R 13/6616* (2013.01); *H01R 13/6625* (2013.01); *H01R 13/6633* (2013.01)

(58) Field of Classification Search
CPC ..... H01R 13/6625
USPC ..... 439/66, 620.13, 700, 823, 824
See application file for complete search history.

(56) References Cited

U.S. PATENT DOCUMENTS 5,081,434 A * 1/1992 Sakamoto ..... H01R 13/7197 333/182
5,096,426 A * 3/1992 Simpson ..... H01R 12/714 29/883
7,467,952 B2 * 12/2008 Hsiao ..... H01R 13/2421 439/66
7,481,678 B2 * 1/2009 Aekins ..... H01R 13/7033 439/620.11
7,670,182 B2 * 3/2010 Morikawa ..... H01R 9/0518 439/620.03
8,007,316 B2 * 8/2011 Costello ..... H01R 13/04 439/607.1
2005/0064739 A1 * 3/2005 Searls ..... H01R 12/57 439/66
2006/0160425 A1 * 7/2006 Fuerst ..... H01R 13/7195 439/638
2010/0330825 A1 * 12/2010 Fan ..... H01R 13/2471 439/82
2012/0322280 A1 * 12/2012 Fuma ..... H01T 13/06 439/125

* cited by examiner

*Primary Examiner* — Tulsidas C Patel
*Assistant Examiner* — Marcus Harcum
(74) *Attorney, Agent, or Firm* — Locke Lord LLP; Tim Tingkang Xia, Esq.

(57) ABSTRACT

An electrical connector includes an insulating body having a plurality of receiving slots, multiple terminals respectively received in the receiving slots, and a passive element. Each of the terminals has an elastic arm. The passive element is disposed at one end of at least one of the elastic arms, and floatable up and down along with the elastic arm. One end of the passive element has a first contact electrically connected to the one end of the elastic arm. The other end of the passive element has a second contact protruding from the receiving slot. The second contact and a first electronic element are electrically connected, and the other end of the elastic arm and a second electronic element are electrically connected.

18 Claims, 5 Drawing Sheets

ELECTRICAL CONNECTOR

CROSS-REFERENCE TO RELATED APPLICATION

This non-provisional application claims priority under 35 U.S.C. §119(a) on Patent Application No. 201520008324.X filed in P.R. China on Jan. 7, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector provided with a passive element.

BACKGROUND OF THE INVENTION

An existing electrical connector includes an insulating body and multiple terminals received in the insulating body. Each of the terminals includes a base and an elastic arm bent upward and extending from the base. A contact portion bends and extends from the elastic arm, and is used for contacting a chip module. A soldering portion extends downward from the base, and is used for being soldered to a circuit board. When the electrical connector and the chip module are mated, the chip module presses against the contact portion downward, such that the contact portion elastically urges against the chip module, thereby forming electrical connection.

However, current electronic products are being developed in a direction of miniaturization, high speed and high frequency, and therefore the entire size of the terminals is increasingly smaller, and a distance between adjacent terminals is also increasingly smaller. When adjusting characteristic impedance of the terminals is required to perform impedance matching, because of limitation of the entire size of the terminals and the distance between the adjacent terminals, it is very difficult to adjust the characteristic impedance of the terminals by adjusting the shape and size of the terminals and adjusting the distance between the adjacent terminals. Accordingly, it is very difficult to adjust the characteristic impedance of the terminals, thereby affecting high frequency performance of the electrical connector.

Therefore, a heretofore unaddressed need exists in the art to address the aforementioned deficiencies and inadequacies.

SUMMARY OF THE INVENTION

In one aspect, the present invention is directed to an electrical connector in which characteristic impedance is easily adjusted to perform impedance matching.

In one embodiment, an electrical connector includes an insulating body, multiple terminals and a passive element. The insulating body is provided with multiple receiving slots. The multiple terminals are correspondingly received in the multiple receiving slots. Each of the terminals has an elastic arm. The passive element is disposed at one end of at least one of the elastic arms, so that the passive element can float up and down along with the elastic arm. One end of the passive element has a first contact electrically connected to the elastic arm. The other end of the passive element has a second contact protruding from the receiving slot. The second contact and a first electronic element are electrically connected, and the other end of the elastic arm and a second electronic element are electrically connected.

In one embodiment, the passive element is any one of a resistor, an inductor and a capacitor.

In one embodiment, each of the passive elements forms a serial-connected circuit with the corresponding terminal.

In one embodiment, the first electronic element is a circuit board or a chip module that has a conducting area.

In one embodiment, the second contact and the first electronic element are mated along a vertical direction, and a contact surface of the second contact is perpendicular to the vertical direction.

In one embodiment, a contact area of the second contact is less than a cross-sectional area of the passive element.

In one embodiment, a surface of the second contact is plated with a noble metal layer for preventing oxidization.

In one embodiment, the insulating body has an upper surface and a lower surface opposite to each other. The multiple receiving slots run through the insulating body from the upper surface towards the lower surface. The passive element is disposed at an upper end of the elastic arm and partially protrudes from the upper surface. The first electronic element is located above the upper surface.

In one embodiment, a positioning member protrudes upward from the upper surface. The positioning member is higher than the second contact, and the positioning member is used for positioning the first electronic element.

In one embodiment, the second electronic element is any one of a resistor, an inductor, a capacitor, a circuit board and a chip module.

In one embodiment, the passive element and the elastic arm are electrically connected in a press-fit manner.

In one embodiment, a notch is depressed from one end of at least one of the elastic arms. A clamping portion is disposed at each of two opposite sides of the notch. The first contact of the passive element is located at the notch and electrically connected to the elastic arm, and the two clamping portions clamp and fix the passive element.

In one embodiment, the passive element and the elastic arm are electrically connected in a soldering manner.

In one embodiment, a flat plate portion extends from the one end of at least one of the elastic arms, and the first contact of the passive element and the flat plate portion are soldered and fixed, and electrically connected.

In one embodiment, a limiting mechanism is optionally disposed at the passive element or/and the insulating body, and the limiting mechanism is used for preventing the passive element from being separated from the insulating body.

In one embodiment, the passive element partially protrudes from the receiving slot. The limiting mechanism includes a boss and a stopping surface. The passive element is provided with the boss, and the stopping surface is disposed on an inside wall of the receiving slot. The stopping surface is located above the boss and used for stopping the passive element from being separated from the insulating body upward.

In one embodiment, the multiple terminals include multiple signal terminals and at least one power supply terminal. The elastic arm of each of the signal terminals is provided with the passive element, and the elastic arm of the power supply terminal is not provided with the passive element.

In one embodiment, the cross-section size of the power supply terminal is greater than the cross-section size of the signal terminal.

In one embodiment, multiple bending portions extend from the elastic arm along a vertical direction, and the multiple bending portions are connected sequentially end to end.

Compared with the related art, certain embodiments of the present invention have the following beneficial advantages. The passive element is disposed at one end of at least one of the elastic arms, so that the passive element can float up and down along with the elastic arm. In the one end of the passive element, the passive element has the first contact electrically connected to the elastic arm. In the other end of the passive element, the passive element has the second contact protruding from the receiving slot. The second contact and the first electronic element are electrically connected. The other end of the elastic arm and the second electronic element are electrically connected. The passive element and the terminal form a serial-connected circuit. When adjusting characteristic impedance of the terminal is required to perform impedance matching, the characteristic impedance of the terminal is adjusted without the need of adjusting the shape and size of the terminal or adjusting the distance between the adjacent terminals. The characteristic impedance of the terminal can be adjusted to perform impedance matching by only adjusting parameters of the passive element. Accordingly, the characteristic impedance of the terminal is easily adjusted, so as to ensure high frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
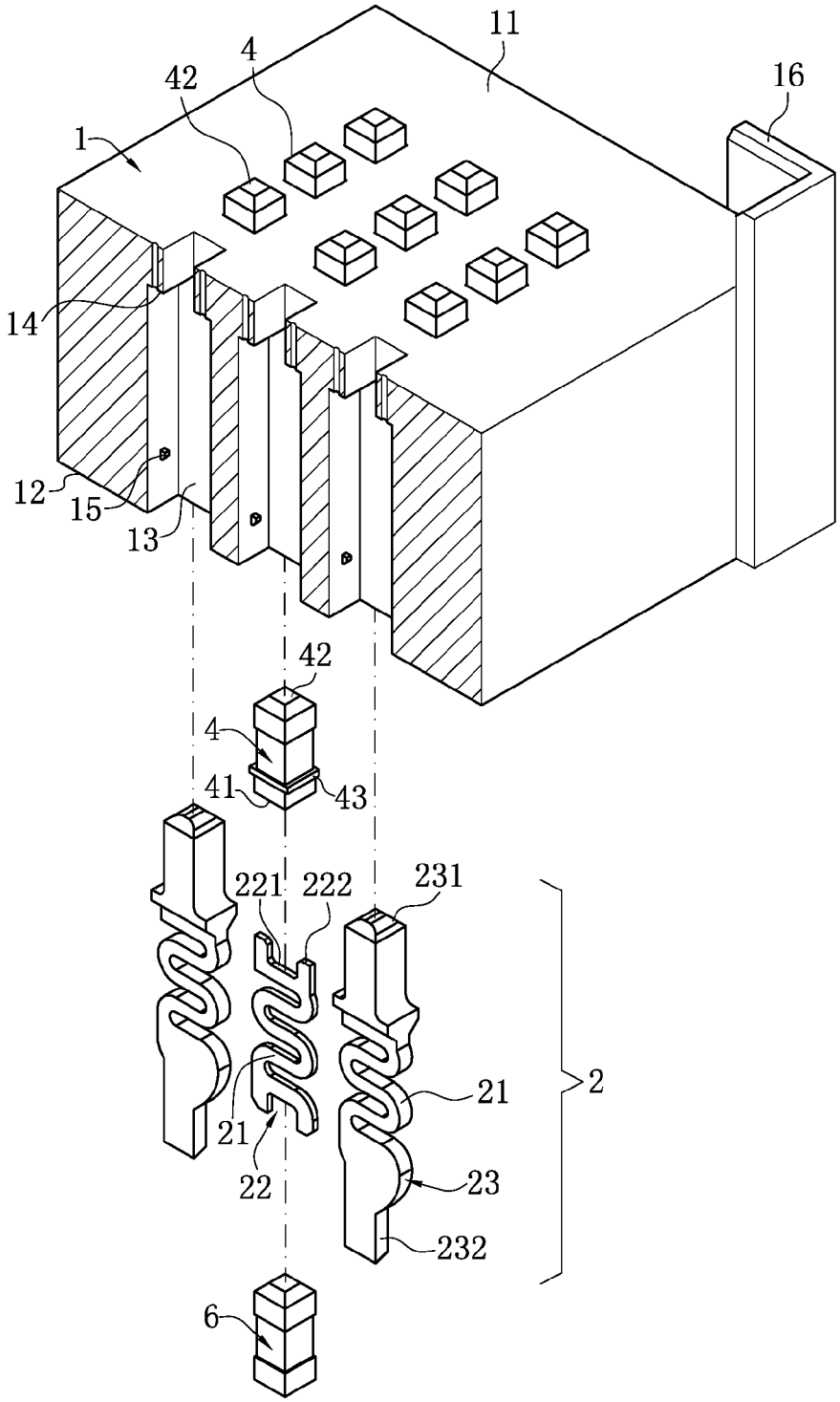
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

Figure 3:
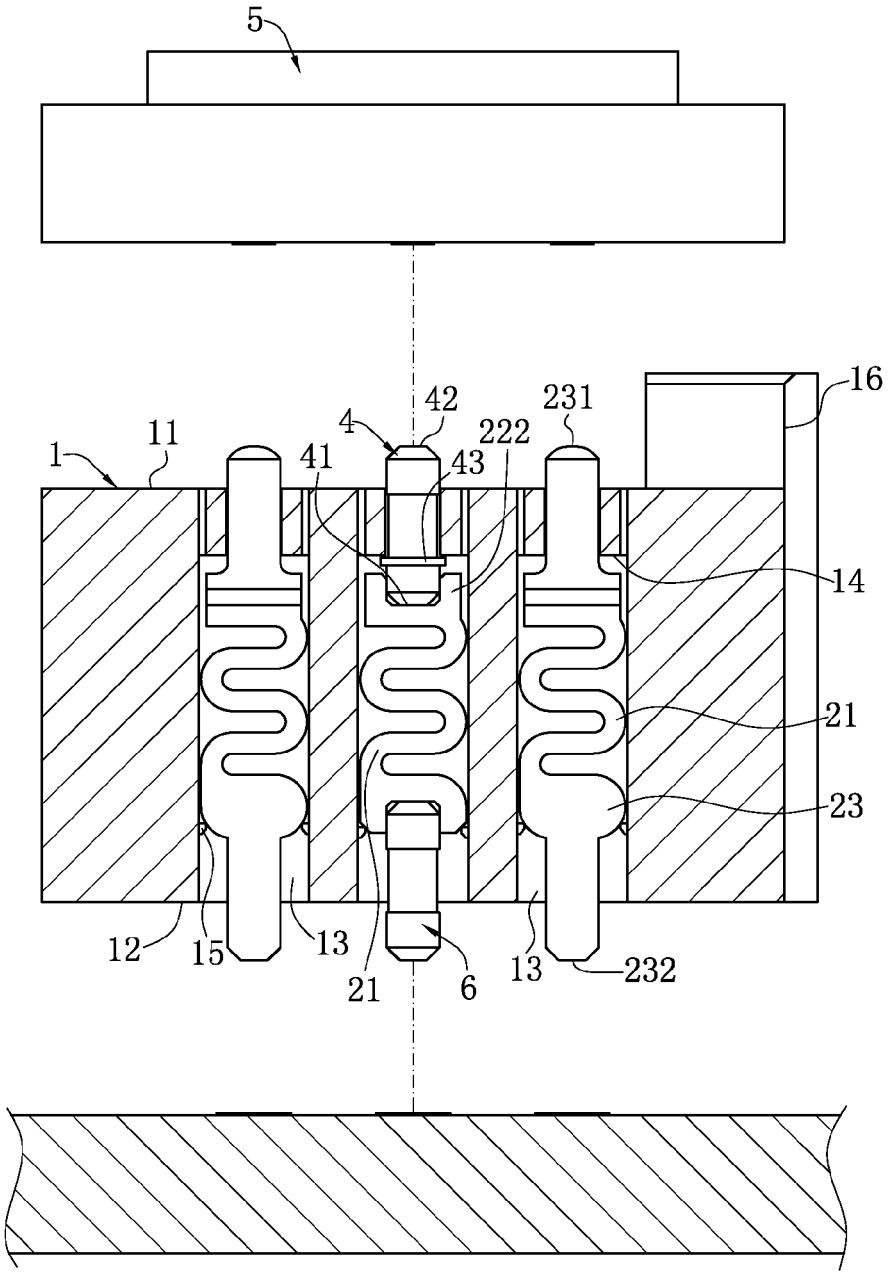
FIG. 3 is a sectional view in which the electrical connector is not mated to a first electronic element according to one embodiment of the present invention.

As shown in FIG. 1 and FIG. 3, an electrical connector according to one embodiment of the present invention includes an insulating body 1, multiple terminals 2, and a passive element 4. The insulating body 1 is provided with multiple receiving slots 13. The multiple terminals 2 are received in the receiving slots 13. The passive element 4 is disposed on at least one of the terminals 2.

Figure 2:
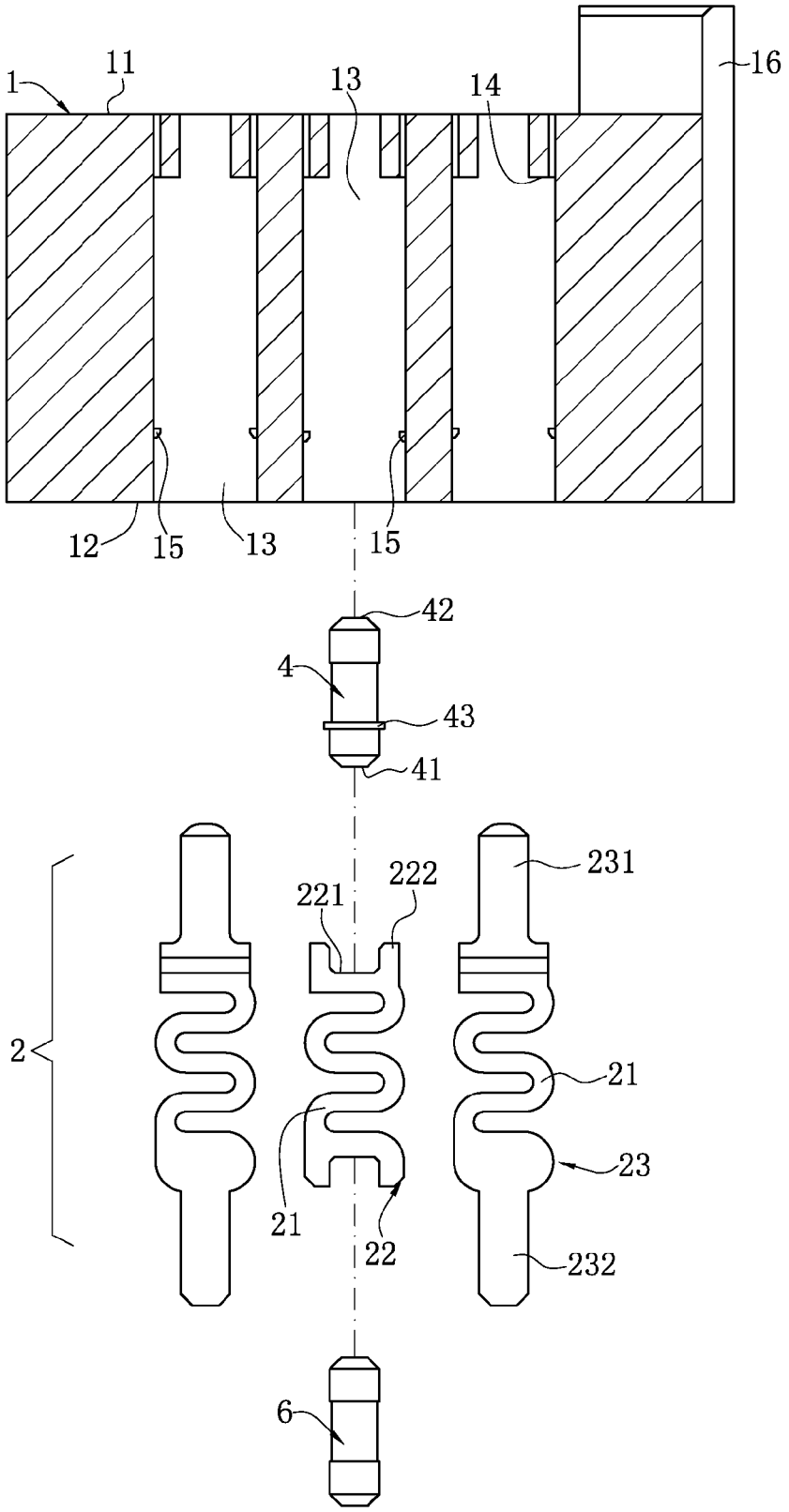
FIG. 2 is a sectional view of the electrical connector according to one embodiment of the present invention.

As shown in FIGS. 1-3, the insulating body 1 has an upper surface 11 and a lower surface 12 disposed opposite to each other. The upper surface 11 and the lower surface 12 are disposed parallel to each other. The multiple receiving slots 13 run through the lower surface 12 from the upper surface 11 downward. The multiple terminals 2 are correspondingly received in the multiple receiving slots 13. The passive element 4 partially protrudes from the receiving slot 13. The transverse size of an upper end of the receiving slot 13 is less than the transverse size of a lower end of the receiving slot 13, that is, the receiving slot 13 is narrower on the top and wider on the bottom. A protruding portion 15 protrudes from an inside wall of the lower end of the receiving 13, and the protruding portion 15 is used for stopping the terminal 2 from being separated from the receiving slot 13 downward. A limiting mechanism (not labeled) is optionally disposed at the passive element 4 or/and the insulating body 1, and the limiting mechanism is used for preventing the passive element 4 from being separated from the insulating body 1. In this embodiment, the limiting mechanism is disposed at the passive element 4 and the insulating body 1. The limiting mechanism includes a boss 43 and a stopping surface 14. The boss 43 protrudes from the periphery of the passive element 4, and the stopping surface 14 is disposed on the inside wall of the receiving slot 13. The stopping surface 14 is located above the boss 43 and used for stopping the passive element 4 from being separated from the insulating body 1 upward. In other embodiments, the limiting mechanism may be individually disposed at the insulating body 1 or the passive element 4, as long as it is ensured that the limiting mechanism can prevent the passive element 4 from being separated from the insulating body 1. A positioning member 16 protrudes upward from the insulating body 1 at an edge of the upper surface 11, and the positioning member 16 is located at a corner of the upper surface 11.

As shown in FIGS. 1-3, each of the terminals 2 has an elastic arm 21. The elastic arm 21 extends along a vertical direction. The elastic arm 21 includes multiple bending portions (not marked), the multiple bending portions are roughly disposed parallel to each other, and the multiple bending portions are sequentially connected end to end to form the elastic arm 21, so that the elastic arm 21 has sufficient elasticity, and can move up and down within a range. The passive element 4 is disposed at one end of at least one of the elastic arms 21, so that the passive element 4 can float up and down along with the elastic arm 21. The passive element 4 is any one of a resistor, an inductor and a capacitor, and parameters of the passive element 4 can be adjusted by adjusting a resistance value of the resistor, an induction value of the inductor, or a capacitance value of the capacitor. One end of the passive element 4 has a first contact 41 electrically connected to one end of the elastic arm 21, and the other end of the passive element 4 has a second contact 42 protruding from the upper surface 11 or the lower surface 12. The second contact 42 and a first electronic element 5 are electrically connected, and the other end of the elastic arm 21 and a second electronic element 6 are electrically connected. The passive element 4 and the terminal 2 form a serial-connected circuit. When adjusting characteristic impedance of the terminal 2 is required to perform impedance matching, the characteristic impedance of the terminal 2 is adjusted without the need of adjusting the shape and size of the terminal 2 or adjusting the distance between the adjacent terminals 2. Instead, by adjusting parameters of the passive element 4, the characteristic impedance of the terminal 2 can be adjusted to perform impedance matching, so that the characteristic impedance of the terminal 2 is easily adjusted, so as to ensure high frequency performance of the electrical connector. The passive element 4 is disposed at one end of the elastic arm 21, that is, the passive element 4 is disposed at a tail end of the elastic arm 21. Therefore, it is not required to cut the terminal 2 from the middle and then mount the passive element 4, such that the passive element 4 can be mounted conveniently, and replaced easily.

As shown in FIGS. 1-3, the multiple terminals 2 include multiple signal terminals 22 and at least one power supply terminal 23. In this embodiment, the elastic arm 21 of each of the signal terminals 22 is provided with the passive element 4, and the elastic arm 21 of each power supply terminal 23 is not provided with the passive element 4. In other embodiments, the elastic arm 21 of the power supply terminal 23 may also be provided with the passive element 4.

As shown in FIGS. 1-3, the passive element 4 is disposed at an upper end of the elastic arm 21 of the signal terminal 22, and the passive element 4 and the elastic arm 21 of the signal terminal 22 are electrically connected in a press-fit manner. A notch 221 is vertically depressed from the upper end of the elastic arm 21 of each of the signal terminals 22. A clamping portion 222 is disposed at each of two opposite sides of the notch 221. The first contact 41 of the passive element 4 is located in the notch 221 and electrically connected to the elastic arm 21, the two clamping portions 222 clamp and fix the passive element 4, and the passive element 4 is fixed to the elastic arm 21 along the vertical direction. In this embodiment, the elastic arm 21 is provided with the notch 221 and the clamping portions 222 to fix the passive element 4 in a press-fit manner. In other embodiments, the elastic arm 21 may be provided with another buckling structure to fix the passive element 4. The second contact 42 protrudes from the upper surface 11, and the second contact 42 can float up and down relative to the receiving slot 13. In this embodiment, the first electronic element 5 is a chip module having a conducting area. The first electronic element 5 is located above the upper surface 11, the second contact 42 protrudes from the upper surface 11, and the second contact 42 and the conducting area of the first electronic element 5 are mated along the vertical direction. The passive element 4 can float up and down along with the elastic arm 21, that is, the passive element 4 can move within a distance. Therefore, when the second contact 42 and the first electronic element 5 are mated, the second contact 42 is subject to a pressing force from the first electronic element 5 and moves downward, to prevent the first electronic element 5 from damaging the passive element 4, and the second contact 42 and the first electronic element 5 are elastically urged, resulting in more stable contact. A contact surface of the second contact 42 is located on the top surface of the passive element 4, and is perpendicular to the vertical direction, and the contact area of the second contact 42 is less than the cross-sectional area of the passive element 4. The contact surface of the second contact 42 is plated with a noble metal layer for preventing oxidization, such as a gold plated layer or palladium plated layer, which is used for preventing the second contact 42 from being oxidized to affect performance of the electrical connection between the second contact 42 and the first electronic element 5.

As shown in FIGS. 1-3, the second electronic element 6 is disposed at a lower end of the elastic arm 21 of the signal terminal 22. In this embodiment, the second electronic element 6 is any one of a resistor, an inductor and a capacitor. That is, the second electronic element 6 is the passive element 4. Therefore, the upper end and the lower end of the elastic arm 21 of the signal terminal 22 are each provided with the passive element 4. The second electronic element 6 and the elastic arm 21 of the signal terminal 22 are also electrically connected in a press-fit manner, the lower end of the elastic arm 21 of each of the signal terminals 22 is also provided with the notch 221 and the clamping portions 222, one end of the second electronic element 6 and the notch 221 as well as the clamping portions 222 are cooperatively fixed, and the other end of the second electronic element 6 and a circuit board (not labeled) are electrically connected. The signal terminal 22 electrically connects the first electronic element 5 to the circuit board using the passive element 4 and the second electronic element 6.

As shown in FIGS. 1-3, the upper end of the elastic arm 21 of the power supply terminal 23 is provided with a contact portion 231, and the lower end of the elastic arm 21 of the power supply terminal 23 is provided with a soldering portion 232. The contact portion 231 is used for contacting the first electronic element 5, and the soldering portion 232 is used for being soldered to the circuit board. The cross-section size of the power supply terminal 23 is greater than the cross-section size of the signal terminal 22, thereby reducing the resistance of the power supply terminal 23, and improving conducting performance of the power supply terminal 23.

Figure 4:
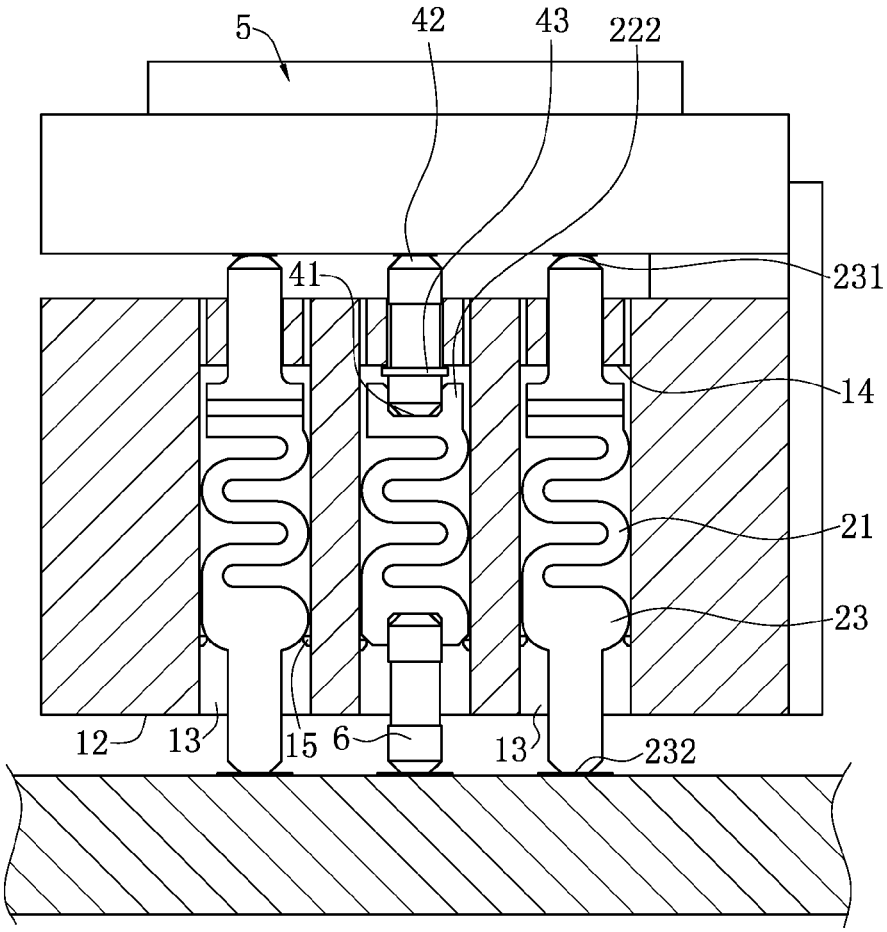
FIG. 4 is a sectional view in which the electrical connector is mated to the first electronic element according to one embodiment of the present invention.

As shown in FIGS. 2-4, during assembly, first the passive element 4 is mounted to the upper end of the elastic arm 21 of the signal terminal 22. The first contact 41 of the passive element 4 is located in the notch 221, and the two clamping portions 222 clamp and fix the passive element 4, so that the passive element 4 can float up and down along with the elastic arm 21. Then the second electronic element 6 is mounted to the lower end of the elastic arm 21 of the signal terminal 22 according to a same method. Further, the multiple signal terminals 22 and the power supply terminal 23 are correspondingly loaded into the multiple receiving slots 13 from bottom upward. In the assembly process, the signal terminals 22 and the power supply terminal 23 may slightly interfere with the protruding portion 15, but this does not affect functions of the signal terminals 22 and the power supply terminal 23. The stopping surface 14 is located above the boss 43 and used for stopping the passive element 4 from being separated from the insulating body 1 upward. The second contact 42 protrudes from the upper surface 11. The positioning member 16 is higher than the second contact 42. The protruding portion 15 is located at the lower end of the elastic arm 21, to prevent the terminal 2 from being separated from the receiving slot 13 downward. The second electronic element 6 partially protrudes from the lower surface 12 and is used for being soldered to the circuit board. The power supply terminal 23 is fixed to the receiving slot 13, and the soldering portion 232 protrudes from the lower surface 12 and is used for being soldered to the circuit board. In this embodiment, both the second electronic element 6 and the soldering portion 232 are soldered to the circuit board. In other embodiments, the second electronic element 6 and the soldering portion 232 may also be electrically connected to the circuit board in a press-fit manner. Finally the first electronic element 5 and the second contact 42 as well as the contact portion 231 are mated, the positioning member 16 is used for positioning the first electronic element 5, the second contact 42 moves downward along with the elastic arm 21 and finally urges against the first electronic element 5, and the contact portion 231 protrudes from the upper surface 11 and contacts the first electronic element 5, thereby completing electrical connection between the first electronic element 5 and the circuit board.

In this embodiment, the passive element 4 is located at the upper end of the elastic arm 21 of the signal terminal 22, the second electronic element 6 is located at the lower end of the elastic arm 21 of the signal terminal 22, the first electronic element 5 is the chip module, and the second electronic element 6 is any one of a resistor, an inductor and a capacitor. In another embodiment, the passive element 4 is located at the upper end of the elastic arm 21 of the signal terminal 22, the second electronic element 6 is located at the lower end of the elastic arm 21 of the signal terminal 22, the first electronic element 5 is the chip module, and the second electronic element 6 is the circuit board. In other embodiments, the passive element 4 may also be located at the lower end of the elastic arm 21 of the signal terminal 22, correspondingly the second electronic element 6 may also be located at the upper end of the elastic arm 21 of the signal terminal 22, the first electronic element 5 is the circuit board, and the second electronic element 6 is a resistor, an inductor, a capacitor, or a chip module, as long as it is ensured that the signal terminal 22 can be electrically connected to the first electronic element 5 and the second electronic element 6.

Figure 5:
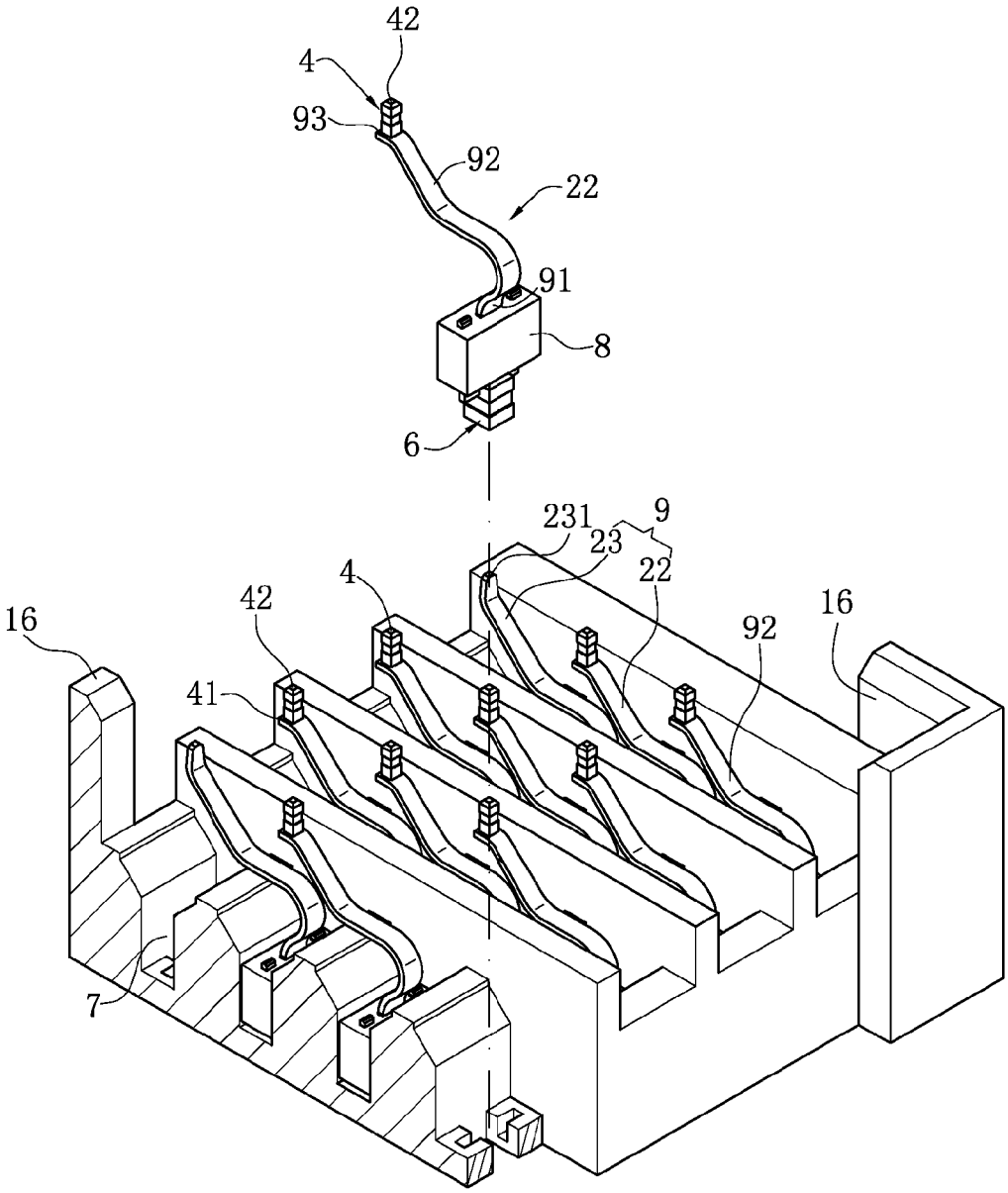
FIG. 5 is a three-dimensional exploded view of an electrical connector according to a second embodiment of the present invention.

Referring to FIG. 5, a second embodiment of the present invention is shown, and the difference between the second embodiment and the first embodiment lies in that: the elastic arm 92 is not provided with multiple bending portions, and the passive element 4 and the elastic arm 92 are electrically connected in a soldering manner. The terminal 9 includes an inserting portion 91. The inserting portion 91 and an insulating block 8 are insert-molded. The insulating body 1 is not provided with the receiving slot 13. The insulating body 1 is provided with multiple accommodating slots 7 correspondingly accommodating the insulating blocks 8. The inserting portion 91 is fixed to the insulating block 8, and the insulating block 8 is fixed to the accommodating slot 7, so that the inserting portion 91 is fixed to the insulating body 1. The elastic arm 92 bends from the inserting portion 91 upward, extends for a distance and then bends forward, and the elastic arm 92 extends out of the accommodating slot 7. The contact portion 231 extends upward from the upper end of the elastic arm 92 of the power supply terminal 23. A flat plate portion 93 extends from the upper end of the elastic arm 92 of the signal terminal 22. The flat plate portion 93 is located outside the accommodating slot 7, can float up and down, and extends horizontally from the upper end of the elastic arm 92 of the signal terminal 22. The flat plate portion 93 is provided with the passive element 4. The first contact 41 of the passive element 4 is soldered and fixed to the flat plate portion 93, and electrically connected to the flat plate portion 93. The passive element 4 can float up and down along with the flat plate portion 93. The passive element 4 may also be fixed to the elastic arm 92 of the signal terminal 22 in a press-fit manner, and can be electrically connected to the elastic arm 92. The lower end of the inserting portion 91 is also provided with the notch 221 and the clamping portions 222. The second electronic element 6 is cooperatively fixed to the notch 221 and the clamping portions 222 (referring to FIG. 2 and FIG. 3), so that the second electronic element 6 and the lower end of the inserting portion 91 are electrically connected.

In summary, the electrical connector according to certain embodiment of the present invention, among other things, has the following beneficial advantages.

(1) The passive element 4 is disposed at one end of at least one of the elastic arms 21. One end of the passive element 4 has the first contact 41 electrically connected to the elastic arm 21. The other end of the passive element 4 has the second contact 42 protruding from the receiving slot 13. The second contact 42 and the first electronic element 5 are electrically connected, and the other end of the elastic arm 21 and the second electronic element 6 are electrically connected. The passive element 4 and the terminal 2 form a serial-connected circuit. When adjusting characteristic impedance of the terminal 2 is required to perform impedance matching, the characteristic impedance of the terminal 2 is adjusted without the need of adjusting the shape size of the terminal 2 or adjusting the distance between the adjacent terminals 2. Instead, by adjusting parameters of the passive element 4, the characteristic impedance of the terminal 2 can be adjusted to perform impedance matching, so that the characteristic impedance of the terminal 2 is easily adjusted, so as to ensure high frequency performance of the electrical connector.

(2) The passive element 4 is disposed at one end of the elastic arm 21. That is, the passive element 4 is disposed at a tail end of the elastic arm 21. Therefore it is not required to cut the terminal 2 from the middle and then mount the passive element 4, such that the passive element 4 is mounted conveniently, and replaced easily.

(3) The passive element 4 can float up and down along with the elastic arm 21. That is, the passive element 4 can move within a distance. Therefore, when the second contact 42 and the first electronic element 5 are mated, the second contact 42 is subject to of a pressing force from the first electronic element 5 and moves downward, to prevent the first electronic element 5 from damaging the passive element 4, and the second contact 42 and the first electronic element 5 are elastically urged, resulting in more stable contact.

(4) The limiting mechanism is disposed at the passive element 4 and the insulating body 1. The limiting mechanism includes the boss 43 and the stopping surface 14. The boss 43 protrudes from the periphery of the passive element 4, the stopping surface 14 is disposed on the inside wall of the receiving slot 13, and the stopping surface 14 is located above the boss 43 and used for stopping the passive element 4 from being separated from the insulating body 1 upward.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body having a plurality of receiving slots;

a plurality of terminals respectively received in the receiving slots, wherein each of the terminals has an elastic arm; and a passive element disposed at one end of at least one of the elastic arms, and floatable up and down along with the elastic arm; and a limiting mechanism disposed on at least one of the passive element and the insulating body, for preventing the passive element from being separated from the insulating body and one end of the passive element has a first contact electrically connected to the one end of the elastic arm, the other end of the passive element has a second contact protruding from the receiving slot, the second contact and a first electronic element are electrically connected, and the other end of the elastic arm and a second electronic element are electrically connected, wherein the terminals comprise multiple signal terminals and at least one power supply terminal, the elastic arm of each of the signal terminals is provided with the passive element, and the elastic arm of the power supply terminal is not provided with the passive element.

2. The electrical connector of claim 1, wherein the passive element is a resistor, an inductor, or a capacitor.

3. The electrical connector of claim 1, wherein each of the passive elements forms a serial-connected circuit with the corresponding terminal.

4. The electrical connector of claim 1, wherein the first electronic element is a circuit board, or a chip module having a conducting area.

5. The electrical connector of claim 1, wherein the second contact and the first electronic element are mated along a vertical direction, and a contact surface of the second contact is perpendicular to the vertical direction.

6. The electrical connector of claim 1, wherein a contact area of the second contact is less than a cross-sectional area of the passive element.

7. The electrical connector of claim 1, wherein a contact surface of the second contact is plated with a noble metal layer for preventing oxidization.

8. The electrical connector of claim 1, wherein the insulating body has an upper surface and a lower surface opposite to each other, the receiving slots run through the lower surface from the upper surface, the passive element is disposed at an upper end of the elastic arm and partially protrudes from the upper surface, and the first electronic element is located above the upper surface.

9. The electrical connector of claim 8, further comprising a positioning member protrudes upward from the upper surface for positioning the first electronic element, wherein the positioning member is higher than the second contact.

10. The electrical connector of claim 1, wherein the second electronic element is a resistor, an inductor, a capacitor, a circuit board, or a chip module.

11. The electrical connector of claim 1, wherein the passive element and the elastic arm are electrically connected in a press-fit manner.

12. The electrical connector of claim 11, wherein a notch is depressed from the one end of at least one of the elastic arms, a clamping portion is disposed at each of two opposite sides of the notch, the first contact of the passive element is located at the notch and electrically connected to the elastic arm, and the two clamping portions clamp and fix the passive element.

13. The electrical connector of claim 1, wherein the passive element and the elastic arm are electrically connected in a soldering manner.

14. The electrical connector of claim 13, wherein a flat plate portion extends from the one end of at least one of the elastic arms, and the first contact of the passive element and the flat plate portion are soldered and fixed, and electrically connected.

15. The electrical connector of claim 1, wherein the passive element partially protrudes from the receiving slot; and wherein the limiting mechanism comprises:

a boss disposed on the passive element; and a stopping surface disposed on an inside wall of the receiving slot, located above the boss, and used for stopping the passive element from being separated from the insulating body upward.

16. The electrical connector of claim 1, wherein the cross-section size of the power supply terminal is greater than the cross-section size of the signal terminal.

17. The electrical connector of claim 1, wherein multiple bending portions extend from the elastic arm along a vertical direction, and the multiple bending portions are connected sequentially end to end.

18. An electrical connector, comprising:

an insulating body having a plurality of receiving slots;

a plurality of terminals respectively received in the receiving slots, wherein each of the terminals has an elastic arm; and a passive element disposed at one end of at least one of the elastic arms along a vertical direction, and floatable up and down along with the elastic arm;

the terminals comprise multiple signal terminals and at least one power supply terminal, the elastic arm of each of the signal terminals is provided with the passive element, and the elastic arm of the power supply terminal is not provided with the passive element, wherein one end of the passive element has a first contact located at a notch depressed from the one end of the elastic arm and electrically connected to the one end of the elastic arm, the other end of the passive element has a second contact protruding from the receiving slot, the second contact and a first electronic element are electrically connected, and the other end of the elastic arm and a second electronic element are electrically connected.

* * * * *